US006199245B1

(12) United States Patent
Blessing

(10) Patent No.: US 6,199,245 B1
(45) **Date of Patent: *Mar. 13, 2001**

(54) MULTI-COMPONENT LAWN AND GARDEN HANDLE

(76) Inventor: Kenneth C. Blessing, 448 Thornehill Trail, Oxford, MI (US) 48371

( * ) Notice: Subject to any disclaimer, the term of this patent is extended or adjusted under 35 U.S.C. 154(b) by 0 days.

This patent is subject to a terminal disclaimer.

(21) Appl. No.: 09/106,572

(22) Filed: Jun. 29, 1998

Related U.S. Application Data

(63) Continuation-in-part of application No. 08/774,949, filed on Dec. 27, 1996, now Pat. No. 5,771,535.

(51) Int. Cl.[7] ..... A46B 5/02

(52) U.S. Cl. ..... 16/430; 16/436; 16/422; 16/900; 16/901; 294/57

(58) Field of Search ..... 16/430, 436, 900, 16/901, 902, 422, 426; 403/379.5, 378; 294/57, 58; 15/144.4, 143.1, 144.2, 144.3, 144.5

(56) References Cited

U.S. PATENT DOCUMENTS

| | | | | |
|---|---|---|---|---|
| 845,592 | | 2/1907 | Stewart . | |
| 2,354,806 | * | 8/1944 | Fletcher | 15/144.4 |
| 2,606,050 | * | 8/1952 | Morris et al. | 15/144.4 |
| 2,710,571 | | 6/1955 | Pfister . | |
| 2,763,506 | | 9/1956 | Denker et al. . | |
| 2,818,291 | | 12/1957 | Corns . | |
| 3,222,699 | | 12/1965 | Zeisig . | |
| 3,724,188 | | 4/1973 | Eads | 56/400.17 |
| 3,773,375 | | 11/1973 | Nehis | 294/54 |
| 3,947,140 | * | 3/1976 | Thomas | 403/379 |
| 4,038,719 | | 8/1977 | Bennett | 16/110 R |
| 4,183,528 | | 1/1980 | An | 273/75 |
| 4,466,152 | * | 8/1984 | Moss et al. | 15/144.4 |
| 4,625,965 | | 12/1986 | Mullins | 273/81.3 |
| 4,704,758 | | 11/1987 | Hoffman | 15/144 B |
| 4,809,388 | | 3/1989 | Dietrich | 15/143 R |
| 4,828,427 | | 5/1989 | Nisenbaum | 404/97 |
| 4,962,561 | | 10/1990 | Hamilton | 15/111 |
| 4,985,961 | | 1/1991 | Kegley | 16/111 R |
| 5,050,261 | | 9/1991 | Hofacker | 15/144 R |
| 5,060,343 | | 10/1991 | Nisenbaum | 16/111 R |
| 5,125,130 | | 6/1992 | Stanish | 16/110 R |
| 5,133,101 | | 7/1992 | Hauser et al. | 15/143.1 |
| 5,159,769 | | 11/1992 | Odorisio | 37/278 |
| 5,263,253 | | 11/1993 | Sainsbury | 30/169 |
| 5,566,418 | * | 10/1996 | Steffen et al. | 16/429 |
| 5,606,761 | * | 3/1997 | Lynch | 15/144.4 |
| 5,609,255 | * | 3/1997 | Nichols | 15/144.3 |
| 5,810,408 | * | 9/1998 | Armstrong | 16/429 |
| 5,937,473 | * | 8/1999 | Lisowski | 15/143.1 |

OTHER PUBLICATIONS

Copy of Brochure for "Easy–Lift Cane."

* cited by examiner

*Primary Examiner*—Chuck Y. Mah
(74) *Attorney, Agent, or Firm*—Bliss McGlynn, P.C.

(57) ABSTRACT

A multi-component handle for use with an implement such that various handle sections can be connected together through various connectors in a multitude of different ways to obtain a handle configuration desired by the user for a particular application. As shown in the application, the grip portions of the handle may be configured in a plurality of positions allowing the handle to be used for a variety of different implements. Further, the handle includes a center section which may be added to conventional shaft handles to add variable grip portions in a simple and efficient manner.

8 Claims, 15 Drawing Sheets

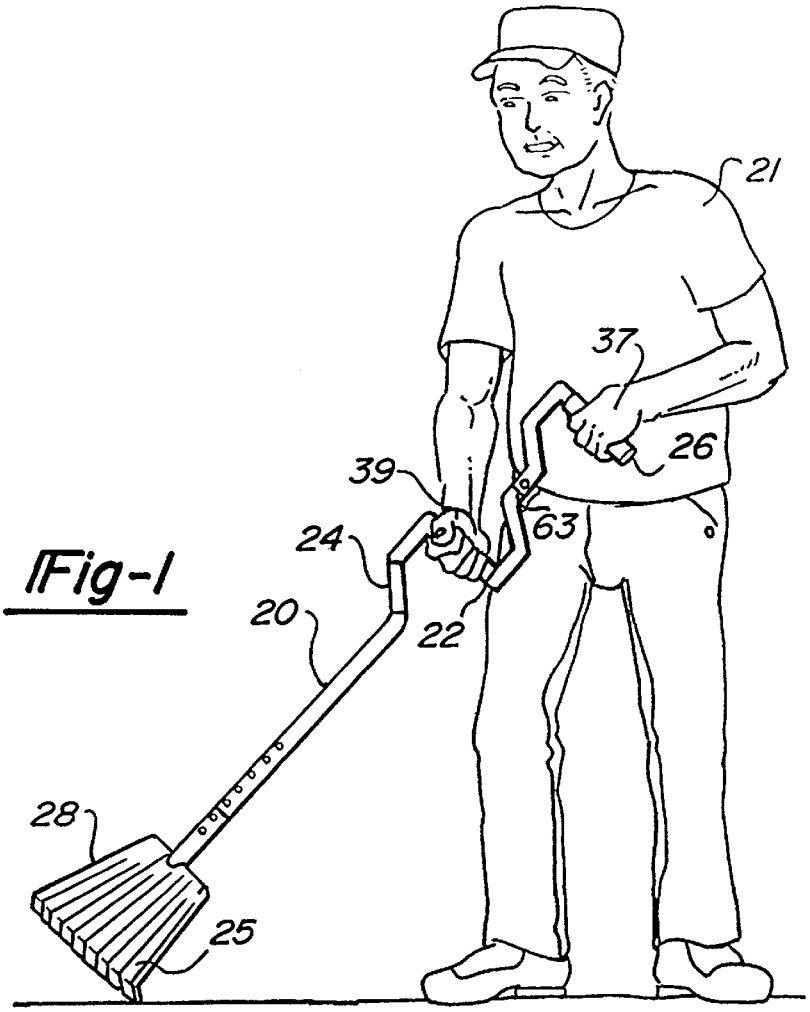
Fig-1
Fig-2a
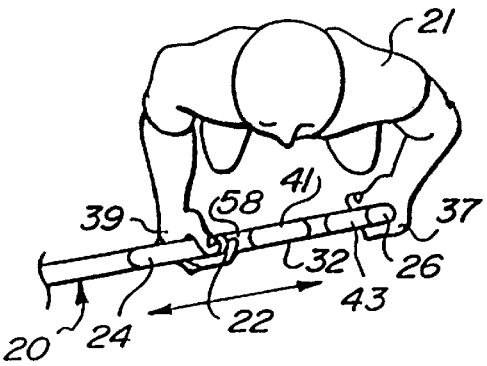
Fig-2b
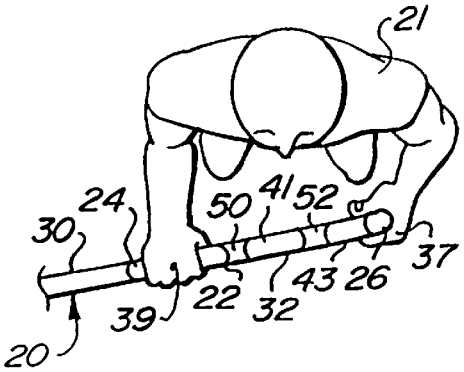

Fig-3
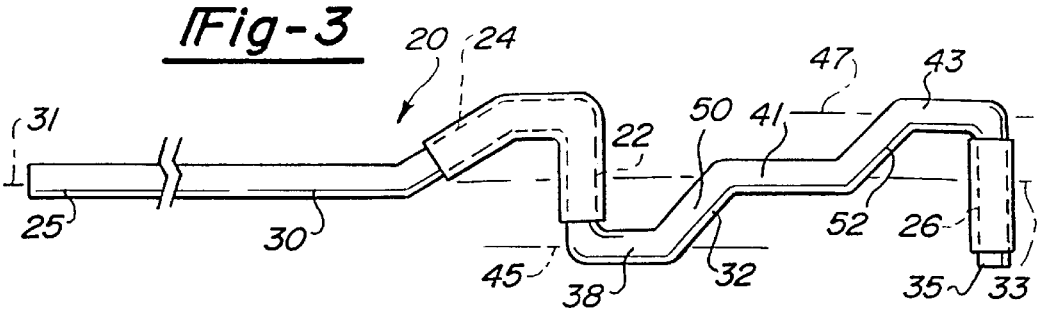
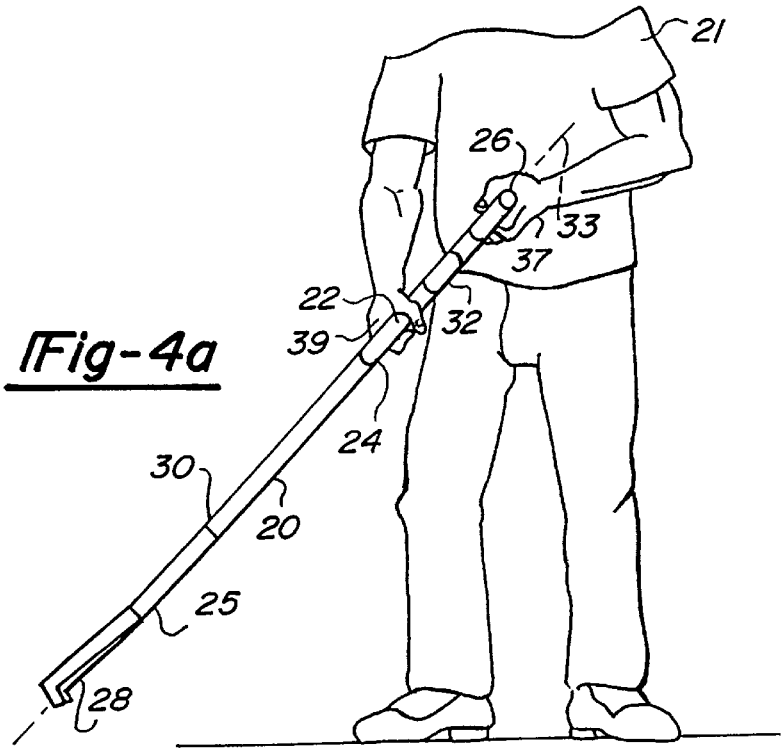
Fig-4a
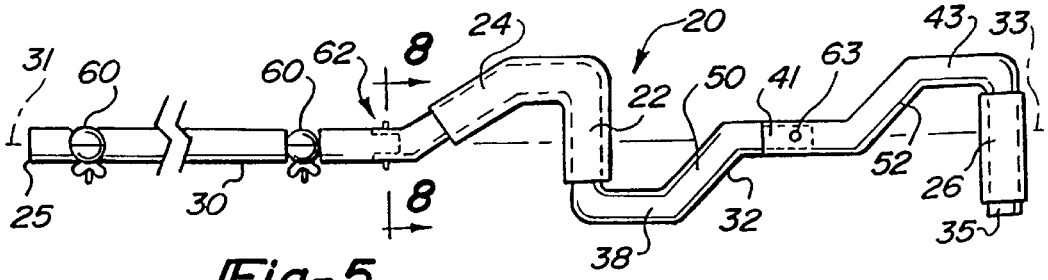
Fig-5

Fig-6
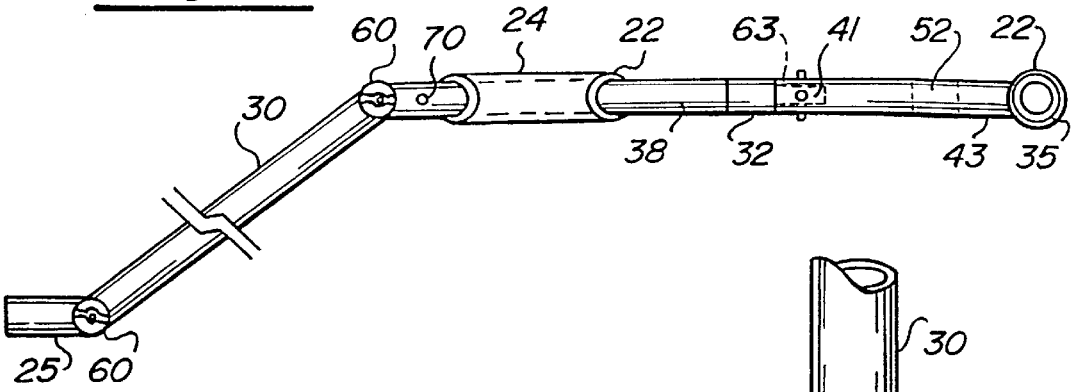
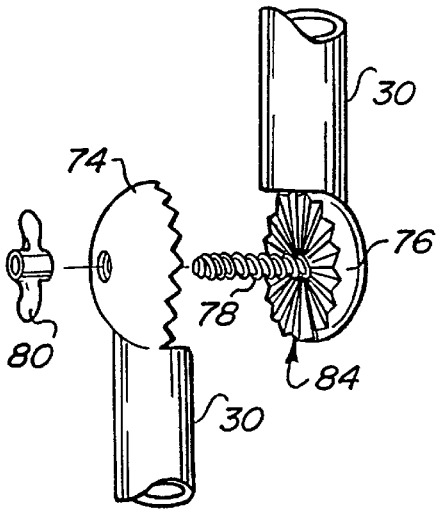
Fig-7b
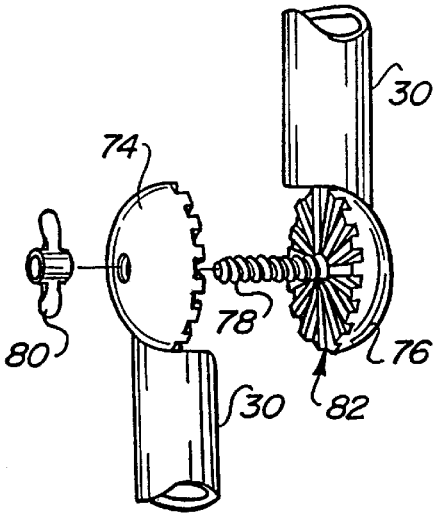
Fig-7a
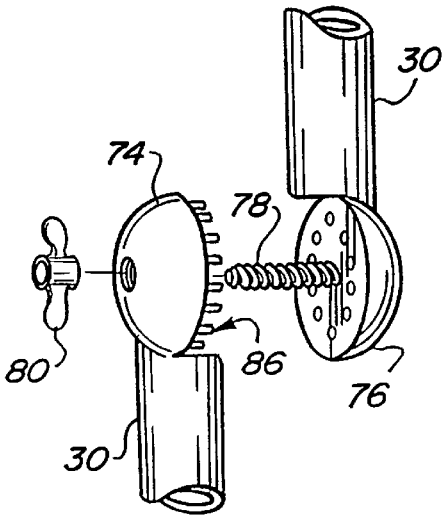
Fig-7c
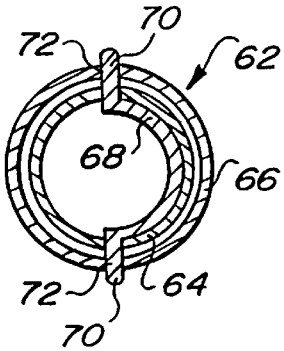
Fig-8

304

306
320
322
314

316
324
326

328
318
330

308
200

201

200

228

420
310

422

424

309
334

336

346

364

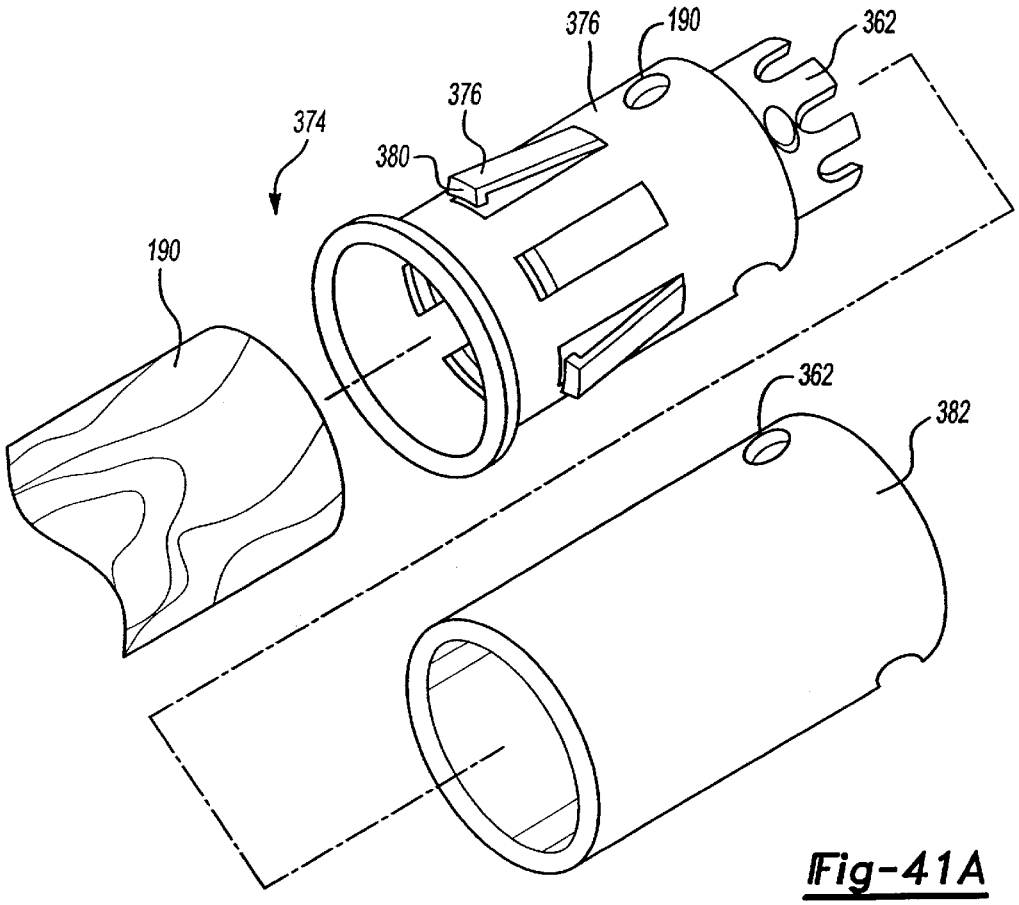
Fig-41A
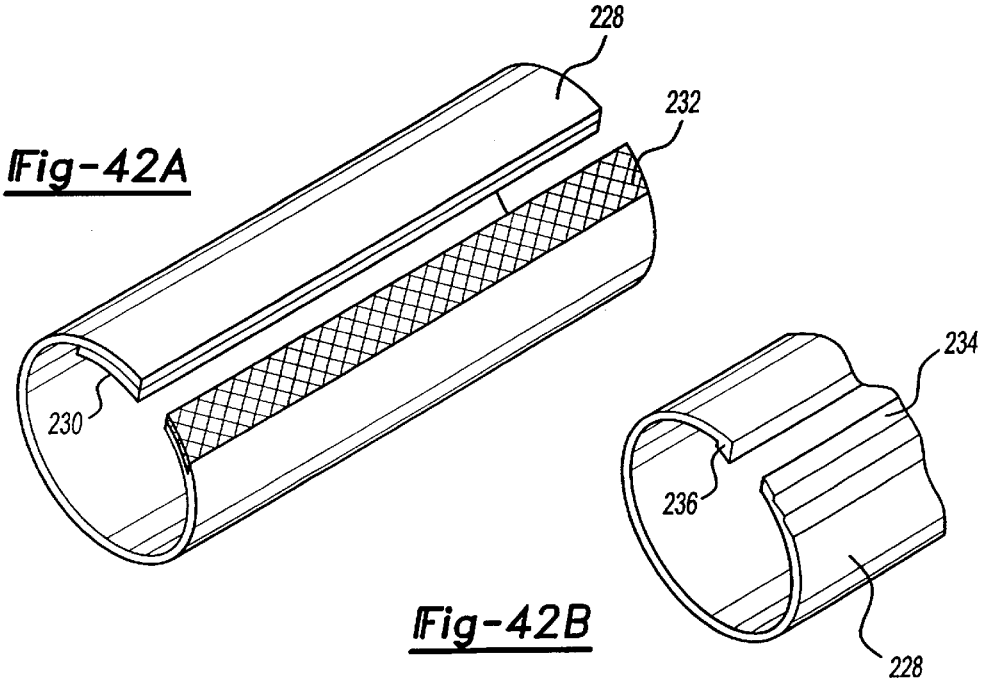
Fig-42A
Fig-42B

MULTI-COMPONENT LAWN AND GARDEN HANDLE

This is a continuation-in-part of application Ser. No. 08/774,949 filed on Dec. 27, 1996. Now U.S. Pat. No. 5,771,535.

BACKGROUND OF THE INVENTION

1. Filed of the Invention

The present invention relates to a handle for use with an implement attached on one end thereof, and more particularly to an ergonomically-shaped handle for use with lawn and garden implements.

2. Description of the Related Art

Most lawn and garden implements use conventional, straight handles; i.e., an elongated, axial member. Straight handles waste energy. A user must exert a certain grip pressure on the handle to prevent the handle from sliding back and forth in the user's hands. If the handle is allowed to slide back and forth in the user's hands, friction, created at the hand/handle interface, causes blisters to form on the user's hands. To prevent blisters from occurring, the user must increase his or her grip pressure on the handle, resulting in greater stress on the joints and limbs. However, as increased force is applied to the implement, a greater force must be applied by the user to maintain proper contact with the handle and prevent movement of the user's hands along the handle. Thus, as the user's hands begin to tire, they begin to slide along the handle and damage to the user's hands starts to occur.

Various types of angled handles have been developed in an attempt to overcome these drawbacks. Angled handles try to take advantage of a user's body shape and position the arm, wrist, hand and torso in a more relaxed posture. However, these handles fail to take into account the different forces applied to the handle during use. The handle should be configured such that the user can grasp the handle and apply or transmit a force directly to the implement attached to the handle. Proper handle configuration prevents increased exertion by the user while allowing the user to grasp and maintain a secure hold on the handle.

SUMMARY OF THE INVENTION

Accordingly, the present invention is a handle having a unique configuration. The handle includes a plurality of hand holds or grip portions that transfer the force generated by the user to an implement attached to the handle. In general, the handle includes two portions; an elongated shaft portion and a handle portion. The handle portion includes at least one hand hold or grip portion positioned perpendicular or at a slight angle to a longitudinal axis or center line of the shaft portion.

In the preferred embodiment, the handle section includes three grip portions. Two of the grip portions extend perpendicular to the longitudinal axis of the shaft portion. The third grip portion extends outward at an angle from the longitudinal axis of the shaft portion. The third grip portion allows the user to position one hand at an angle to the longitudinal axis of the shaft portion while the other hand is positioned perpendicular to the longitudinal axis of the shaft portion. Grasping the handle in this position; i.e., placing the user's hands where indicated, enables the user to transmit increased energy to the implement while minimizing nonproductive or wasted energy in the form of friction or gripping force.

The handle may also include a straight portion or section forming an additional grip portion that coincides with or is parallel to the longitudinal axis of the shaft portion. Such a configuration provides a versatile handle for use with an assortment of different implements. Varying the position of the user's hands on the handle relative to the particular implement used helps to reduce the back and forth motion occurring during use and correspondingly reduces user fatigue and injury.

A further embodiment includes an adjustable pivot joint in the shaft portion. The pivot joint allows the shaft portion to be twisted, turned and repositioned to further conform the handle/implement combination to the configuration of the user rather than conforming the user to the handle/implement combination.

A handle according to the present invention reduces user fatigue and increases the force transferred through the handle to the implement. It should be appreciated that the handle distributes the forces occurring during use on the flats of the palm and fingers and directly to the muscles in the arm as opposed to the wrist and gripping muscles. The handle design reduces stress while applying more force to the implement. Finally, the handle configuration may take various shapes while still achieving the objects and goals of the invention as will be apparent from a review of the drawings and the detailed specification.

BRIEF DESCRIPTION OF THE DRAWINGS

FIG. 1 is a perspective view of a handle according to the present invention shown in use with a rake implement attached thereto.

FIG. 2*a* is a top view of the handle of FIG. 1.

FIG. 2*b* is a top view of the handle of FIG. 1 with the user's front hand positioned on a front grip portion.

FIG. 3 is a side view of a handle of FIG. 1.

FIG. 4*a* is a perspective view of the handle of FIG. 1 rotated 90 degrees and used with a shovel implement attached thereto.

FIG. 5 is a top view of the handle of FIG. 1 including a plurality of pivot joints and a handle adjustment feature.

FIG. 6 is a side view of the embodiment of FIG. 5.

FIGS. 7*a*–7*c* illustrates several embodiments of a pivot joint used in connection with the utility handle of FIG. 5.

FIG. 8 illustrates a locking assembly to prevent rotation of the handle about its longitudinal axis.

DETAILED DESCRIPTION OF THE PREFERRED EMBODIMENT(S)

Figure 4B:
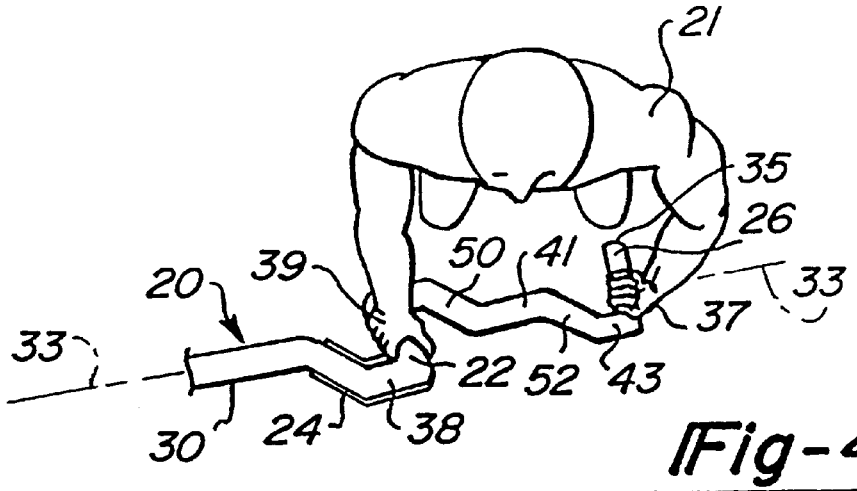
FIG. 4*b* is a partial top view of the handle of FIG. 4*a*.

Turning now to the drawings, and more particularly to FIGS. 1–4*b*, a handle 20, according to one embodiment of the present invention, is shown. The handle 20 is typically used with an implement 28 attached to an implement end 25 of the handle 20. As shown in the figures, a variety of implements 28 may be attached to the handle 20 for use in performing various tasks. For instance, in FIG. 1, the handle 20 is shown in one position with a rake implement. In FIG. 4*a*, the handle is shown rotated 90 degrees from its position in FIG. 1 and used with a shovel.

Turning to FIG. 3, specific portions of the handle 20 will now be set forth in further detail. The handle 20 is a contiguous, one-piece member starting at an implement end 25 and terminating at an upper end 35. The handle 20 includes a shaft portion 30 and a handle portion 32. The handle portion 32 has a first longitudinal axis 33. The shaft portion 30 is an elongated axial member having a second longitudinal axis or center line 31. As shown in FIG. 3, the first longitudinal axis 33 is coincident with the second longitudinal axis 31. However, as shown in FIG. 6, the respective axes may extend at an angle to one another. While disclosed herein as a tubular member, the handle 20 may be made with a variety of shapes and cross-sections, such as square or rectangular, or any shape having a resistance to torque or bending stress.

The handle portion 32 includes, as previously set forth, a plurality of grip portions 22, 24, 26. Viewing the grip portions 22, 24, 26 separately, the rearward grip portion 26 is disposed at the upper end 35 of the handle 20 and the front grip portion 24 is closest to the shaft portion 30. The middle grip portion 22 is positioned between the rear grip portion 26 and the front grip portion 24. As illustrated in FIG. 3, the handle portion 32 is positioned generally along the first longitudinal axis 33. The rear grip portion 26 extends transverse the first longitudinal axis 33. The rear grip portion 26 also lies in the same reference plane as the first longitudinal axis 33, the shaft portion 30 and the middle grip portion 22. When used as shown in FIG. 4*a*, the user 21 grasps the rear grip portion 26 with his left hand 37 and, moving forward along the handle portion 32 toward the implement end, positions his right hand 39 at the middle grip portion 22.

Turning to FIG. 2*b*, when using the handle 20 in connection with a rake implement 28, such as shown in FIG. 1, the user can rotate the handle 20 such that the hand grip portions 22, 26 are substantially vertical. See particularly FIGS. 2*a*–2*b* wherein the user 21 has an ergonomical handle 20 designed to directly apply pulling power to the implement 28 without having to increase the grip force of the user. FIG. 2*b* illustrates a user 21 having his right hand 39 placed on the front grip portion 24. Use of the front grip portion 24 allows the user 21 to apply a downward force on the handle 20, while the force exerted by the user's 21 left hand 37 on the rear grip portion 26 to move the handle remains in line with the first longitudinal axis 33. The user's left hand 37 remains perpendicular to the first longitudinal axis 33 and thus there is no back and forth motion of the left hand 37 along the rear grip portion 26. Turning to FIG. 4*a*, the handle 20 is shown in use with a shovel. The handle 20 is rotated 90 degrees such that the transverse axis of the middle and rear grip portions 22, 26 are substantially horizontal. Thus, a single handle 20 can be repositioned and used with several implements 28.

Returning to FIG. 3, the handle 20 is shown to include additional sections or portions. A connecting portion 41 is positioned between the respective middle and rear grip portions 22, 26. The connecting portion 41 has a longitudinal axis substantially parallel to or coinciding with the first longitudinal axis 33. The handle 20 further includes a pair of offset portions 38, 43 each having a longitudinal axis 45, 47 parallel to that of the shaft portion 30. The offset portions 43, 38 are joined through angled or skewed portions 50, 52 to the connecting portion 41. It should be appreciated that use of the various grip portions 22, 24, 26 enables the user 21 to vary his or her hand positions on the handle 20 in the most ergonomical fashion.

Turning now to FIGS. 5–6, an alternate embodiment of the present invention is shown. Parts common to those of FIG. 1 are given the same numerals and further explanation thereof is omitted. As shown in FIG. 5, the handle 20 includes a rotational connection 62 (see FIG. 8) which allows the shaft portion 30 to be rotated about an angle of 360 degrees depending upon a plurality of discreet adjustment points. As shown in FIG. 8, rotation of the shaft portion 30 with respect to the handle portion 32 is accomplished by providing an inner tube 64 on the shaft portion 30 and outer tube 66 on the handle portion 32. The inner tube 64 is disposed in and rotates within the outer tube 66 of the handle portion 32. A detent mechanism 68 includes pins 70 extending outward through ports 72 in the handle 32 and shaft portion 30. The rotational connection 62 enables the shaft portion 30 to be rotated and locked in any one of a number of discreet positions.

Turning to FIG. 6, the handle 20 may also include an additional rotational connection 63 disposed in the connecting portion 41. As used, the rotational connection 63 may be similar to rotational connection 62. It should be appreciated that rotational connection 63 provides additional versatility in that the rear grip portion 26 may be rotated about an angle of 360 degrees independently of the front 24 and middle 22 grip portions. Also, the connecting portion 41 may extend telescopically to increase the axial distance between the rear grip portion 26 and the middle grip portion 22.

The handle 20 also includes a plurality of pivot joints 60 allowing the implement end 25 of the shaft portion 30 to be positioned in a variety of positions. As shown in FIG. 6, the implement end 25 may be disposed below and still parallel to the longitudinal axis 33 of the handle 20 as shown in FIG. 5. The pivot joints 60 are shown in greater detail in FIGS. 7*a*–7*c*. The pivot joints 60 are formed of two complementary surfaces 74, 76 each attached to respective ends of the shaft portion 30. The complementary surfaces 74, 76 are interconnected with a threaded fastener 78 and wing nut 80. Tightening the wing nut 80 on the fastener 78 causes the two complementary surfaces 74, 76 to come together and mate in a fixed position whereby the shaft portion 30 can be secured in a variety of angular positions. FIG. 7*a* shows a square-toothed complementary surface 82; FIG. 7*b* shows a v-toothed complementary surface 84; and FIG. 7*c* shows a pin and corresponding socket assembly 86.

Figure 9A:
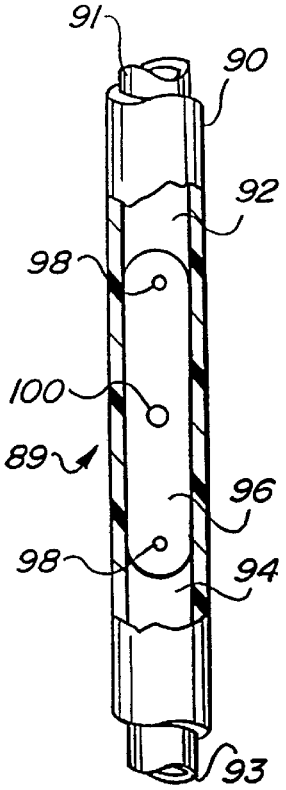
FIGS. 9*a*–9*b* illustrate a means for folding the handle.
Figure 9B:
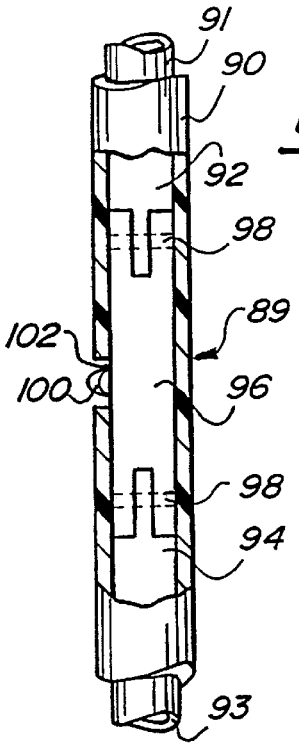

Turning now to FIGS. 9*a*–9*b*, a device 89 for folding the handle 20 into a compact package to reduce its storage size is shown. The shaft portion may be divided into sections 91, 93, and respective ends 92, 94 of the sections 91, 93 are coupled to a pivotal connection or link 96 via pins 98. Both sections 91, 93 may be folded about the link 96. When the handle 20 is unfolded, the collar 90 is placed over the link 96 to lock the sections in place and prevent pivoting. The collar 90 is locked by a detent mechanism 100, preferably a spring loaded plunger, that engages an opening 102 on the collar 90 to hold the collar 90 in place. To fold the handle 20, the detent pin 100 is depressed and the collar 90 is slid or moved to one side of the link 96 to expose the link 96 and enabling the respective sections 91, 93 to be folded to adjacent positions.

Figure 10A:
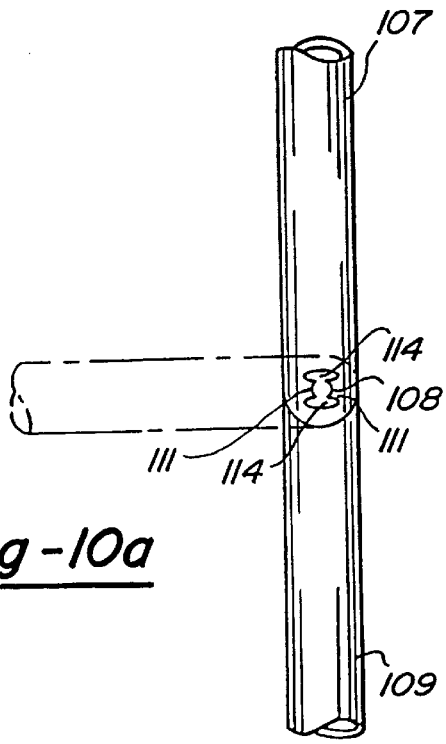
FIGS. 10*a*–10*b* illustrate a second embodiment of a means for folding the handle.
Figure 10B:
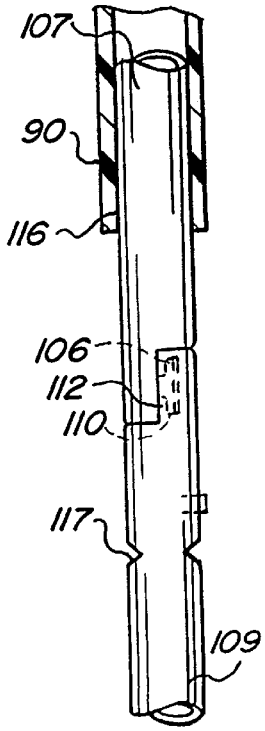

An additional means to fold the assembly is shown in FIGS. 10*a*–10*b*. As shown, a male locking nut or projection 106 and a female engagement opening 108 are respectively positioned on opposite sides of discreet sections 107, 109 of the shaft portion 30. The male locking projection 106 includes lugs 110 spaced from and forming a gap 112 with the shaft portion 30. The lugs 110 correspond to shaped openings 114 on the female engagement opening 108. The two may be slip-fit such that the openings 114 are placed over the lugs 110 at a 90 degree angle. When rotated 90 degrees, the lugs 110 engage the flat surfaces 111 of the handle to provide positive engagement. Similar to the previous embodiment, a collar 90 having a detent prong 116 is slid over the connection and engages a detent slot 117 to lock the handle 20 in the expanded or open position.

Figure 11:
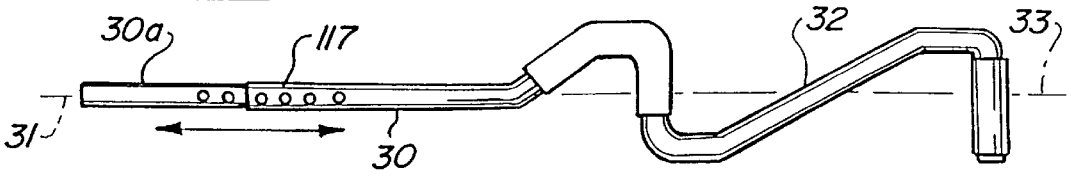
FIG. 11 is a first alternative embodiment of the handle of FIG. 1 including a telescopic shaft shown in plan view.

Turning now to FIG. 11, an additional embodiment of a handle 20 is shown. The handle 20 includes a telescopic or telescoping shaft portion 30*a* which allows the user to extend the overall length of the shaft portion 30. A suitable means for locking the telescopic shaft portion 30 in place, such as spring loaded detent pins 117, may be used. Pivot joints, as shown in FIGS. 7*a*–7*c*, may also be added to allow the implement 28 to be moved to any of several angular positions.

Figure 12:
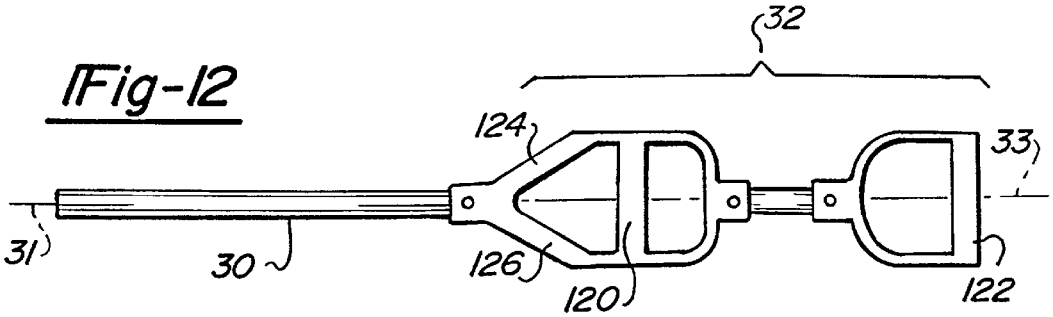
FIG. 12 is a second alternative embodiment of a handle according to the present invention shown in plan view.

Turning now to FIG. 12, another alternative embodiment of the handle 20 is shown. As shown, the handle 20 includes two grip portions 120, 122 extending substantially perpendicular or transverse the first longitudinal axis 33. The handle 20 also includes two oblique grip portions 124, 126 extending outward with respect to the first longitudinal axis 33. The embodiment further illustrates the various configurations the handle 20 may take to provide the user 21 with a plurality of hand grip positions.

Figure 13:
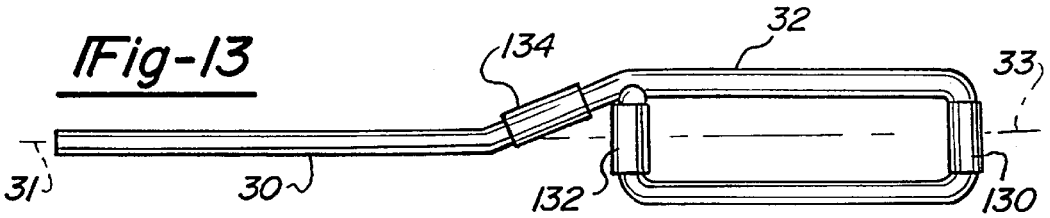
FIG. 13 is a third alternative embodiment of a handle according to the present invention shown in a plan view.

FIG. 13 shows a further embodiment of a handle 20 as a unitary tubular member piece formed to include at least two hand grip portions 130, 132 perpendicular to the first longitudinal axis 33. The handle 20 further includes at least one hand grip portion 134 disposed at an angle with respect to the first longitudinal axis 33.

Figure 14:
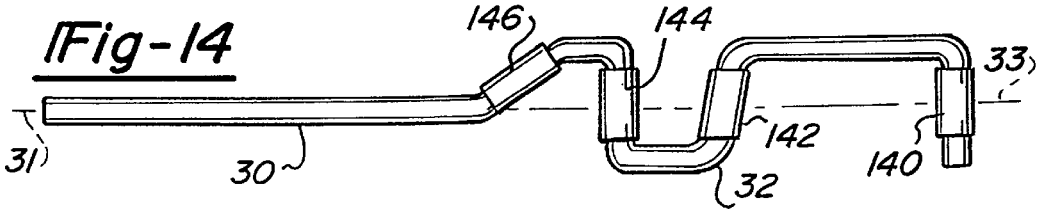
FIG. 14 is a fourth alternative embodiment of a handle according to the present invention shown in plan view.

FIG. 14 is a further embodiment showing a handle 20 having four grip portions 140, 142, 144, 146. Three of the grip portions 140, 142, 144 are positioned substantially transverse the first longitudinal axis 33 and the fourth grip portion 146 is angled or skewed with respect to the first longitudinal axis 33 of the shaft portion 30.

Figure 15:
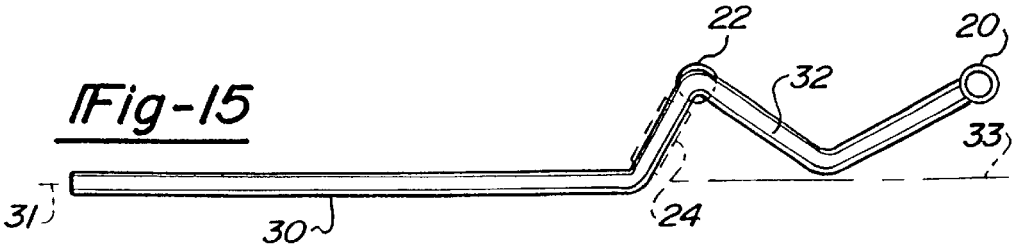
FIG. 15 is a fifth alternative embodiment of a handle according to the present invention shown in plan view.

Turning now to FIG. 15, the utility handle 20 of FIG. 15 is similar to that of FIG. 11 except that the middle and rear grip portions 22, 26 and front grip portion 24 are spaced from a single reference plane defined by the first longitudinal axis 33. If, for example, the first longitudinal axis 33 lies in a plane extending perpendicular to the drawing; i.e., FIG. 11 illustrates a side view, then the handle portion 32 extends above and is positioned outside of the plane.

Thus, the disclosed ergonomic handle 20 for lawn, garden and home use provides a superior alternative to straight or slightly angled handles. The handle 20 of the present invention positions the user's 21 hands in a more vertical, horizontal or angular fashion to said handle while maintaining a comfortable hand position. When using a handle 20 according to the present invention, the cup or palm of the hand is in a more perpendicular direction to the center line of the forearm which allows a more natural position of the body; i.e., the wrist. Further, the handle reduces blisters caused by a sliding back and forth motion on the palm which occurs with straight or slightly angled conventional handles.

Finally, the handle of the above invention evenly distributes the forces onto the flats and forefingers of the hands, thus transferring it easily to the arm muscles to reduce stress on the wrists. Furthermore, the handle 20 requires less work to operate the implement 28 attached to the shaft portion 30. It should be appreciated that various modifications, changes and other substitutions may be made while remaining within the scope of the instant invention.

Figure 16:
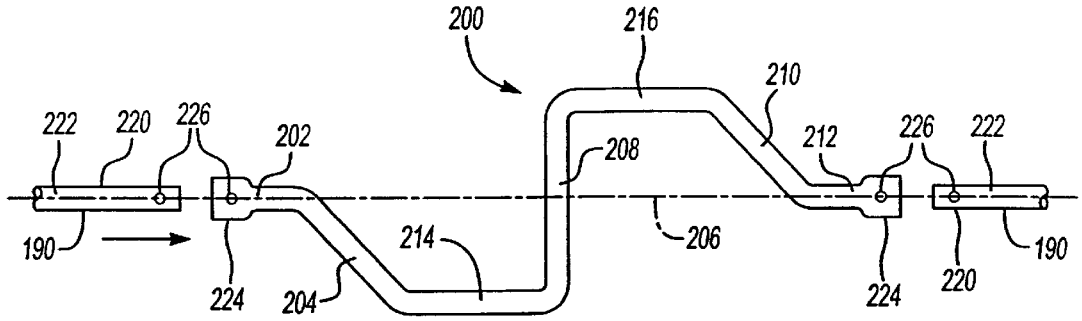
FIGS. 16–18 are front views of a handle section according to the present invention.
Figure 17:
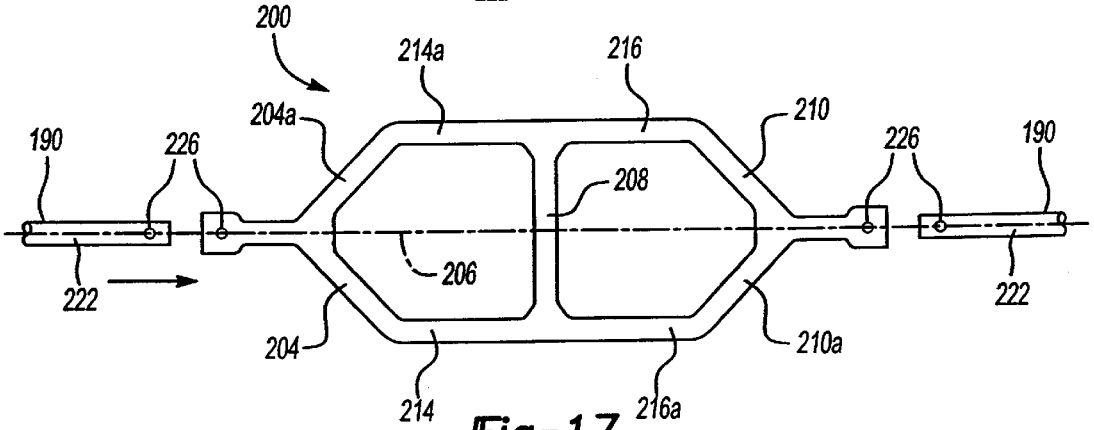
Figure 18:
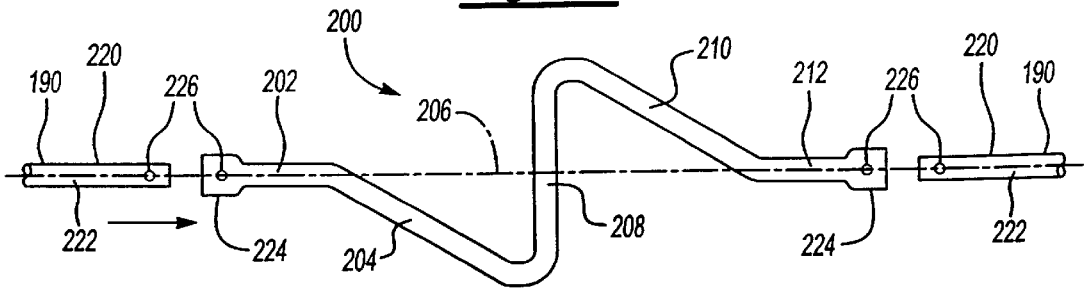

Turning now to FIGS. 16–18, several embodiments of a handle configuration which may be used as a center section 200 of a handle are shown. These center sections 200 may be used as an add-on for modifying conventional handle configurations. For example, a standard handle configuration for a spade-type shovel might be a straight or longitudinally extending wood handle 190. Using one of the embodiments shown in FIGS. 16–18, the conventional wood handle may be modified to include one of the center sections 200 shown and thus increase the versatility of the handle.

Modification of the standard longitudinal wood handle is accomplished by cutting the shaft into separate pieces. The pieces are pulled apart and the center section 200 is then inserted between them and attached at its respective ends to the wood handle to form the modified handle set forth above. Thus, conventional handles may be modified according to one embodiment of the invention.

Turning now to the specifics of the handles shown in FIGS. 16–18. For illustrative purposes, the handle 190 to which one of the center sections 200 is connected is a conventional straight wood handle. It is known to use other types of handles such as those having a different configurations other than a straight handle, such as a t-type handle. Further, the handle may be made of a variety of materials other than wood. Various embodiments of a center section 200 are illustrated in FIGS. 16–18, each center section 200 includes a first longitudinal section 202, a first skewed section 204 extending outward from the longitudinal axis 206, a transverse section 208 extending transverse or perpendicular the longitudinal axis 206, a second skewed section 210 extending outward from the longitudinal axis 206 and a second longitudinal section 212 extending along the longitudinal axis 206. The longitudinal axis 206 represents a longitudinal line extending coincident with and between the first longitudinal section 202 and the second longitudinal section 212.

As shown in FIG. 16, the center section 200 may also include a first intermediate section 214 offset from and parallel the longitudinal axis 206. The first intermediate section 214 connects the first skewed section 204 with the transverse section 208. Additionally, a second intermediate section 216, also offset from and parallel the longitudinal axis 206, connects the transverse section 208 with the second skewed section 210.

Figure 16A:
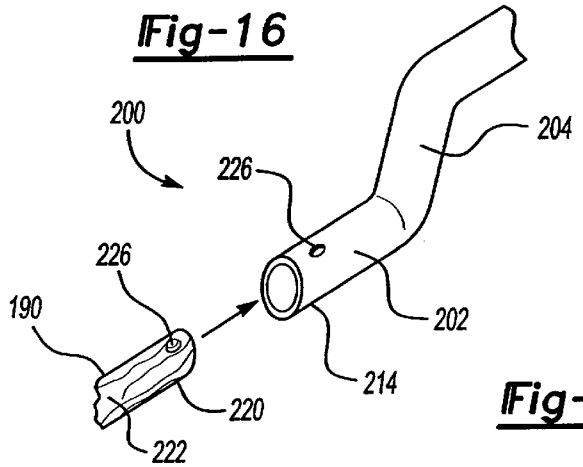

In use, the center section 200 is connected to the conventional handle 190 as set forth above by cutting the handle 190 in half and attaching the ends 220 of the halves 222 of the handle 190 to the first and second longitudinal sections 202, 212 (see FIG. 16*a*). The connections may be of any one of several types of connections which are disclosed later herein, including inserting the ends 220 into a socket 224 formed on the respective first and second longitudinal sections 202, 212. The halves 222 are then fastened into place with a rivet, screw, nail or some other type of fastener extending through an orifice 226 in both the socket 224 and the handle end 220. Such a construction forms a one piece handle having a center section 200 disposed between two halves 222 of the wood handle 190. While disclosed as cutting the handle 190 in halves 222, the handle 190 may be cut at any position with the center section 200 placed between the two ends 220 produced by the cut.

The center section 200 provides a handle having a plurality of gripping portions; i.e., the skewed 204, 210 and transverse 208 sections form grip portions. While these sections form the main grip portions, the handle is designed such that it may be gripped at any point along the handle. Which section forms a grip portion depends upon the particular use selected by the user. A detachable grip 228 (see FIGS. 42*a*–42*d*) may be placed over the respective sections; i.e., transverse 202, skewed 204, 210 or intermediate 214, 216. Additionally, the detachable grip 228 may be positioned anywhere on the handle as required by the user. Thus, the handle can be used in a variety of positions depending upon the particular use.

Turning briefly to FIG. 17, a center section 200 is shown having two first skewed sections 204, 204*a*, two second skewed sections 210, 210*a*, connected with the transverse section 208 via two first intermediate sections 214, 214*a* and two second intermediate sections 216, 216*a*. As set forth above, the function of such a central section 200 is to provide a plurality of gripping portions at the various sections.

Figures 19, 20, 21, 22, 23, 24, 25, 26, 27, 28, 29, 30, 31, 32, 33, 34, 35, 36, 37, 38, 39, 40, 41, 42:
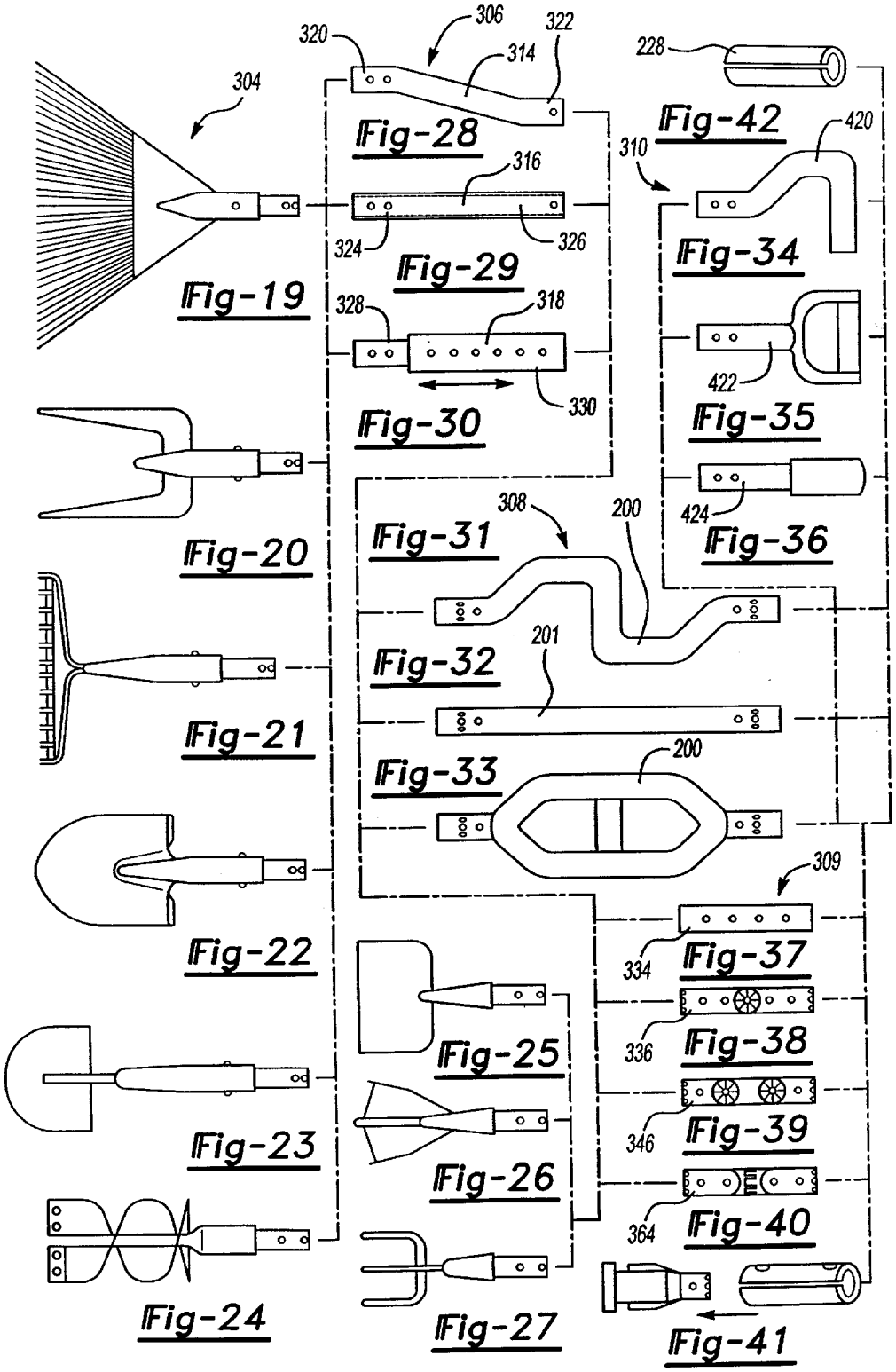
FIGS. 19–27 illustrate several embodiments of implements that may be used in connection with the present invention.
FIGS. 28–30 illustrate various shaft sections for use with a handle according to the present invention.
FIGS. 31–33 illustrate various center sections for use with a handle according to the present invention.
FIGS. 34–36 show various upper sections for use with a handle according to the present invention.
FIGS. 37–41 and 43–44 show various embodiments of connectors for use in connecting the various sections to form a handle according to the present invention.

Turning now to FIGS. 19–45, there is shown a component system 300 for forming a multi-part handle 302 and an implement 304 combination. FIGS. 19–27 show various types of implements 304 that can be used with the multi-part handle 302. The figures, while showing different implements 304, are not meant to be exclusive, but are merely examples of the types of implements 304 that can be used with the multi-part handle 302 of the present invention. As disclosed further herein, the multi-part handle 302 is comprised of three parts or sections, a shaft section seen generally at 306, a center section seen generally at 308 and an upper section seen generally at 310. As used herein, "section" identifies any one of the three disclosed sections, the shaft section 306, the center section 308 or the upper section 310. The center section 308 may be of the design or type shown in FIGS. 16–18 or it may comprise some other shape or configuration as shown herein. For example, FIG. 32 shows a straight handle 312 having means at each end for connecting the center section 308 to the shaft section 306 and the upper section 310. As set forth previously, the respective sections or components of the multi-part handle 302 may be connected in a variety of ways. Specific types or means for connecting the individual components or sections are shown in FIGS. 37–41 and FIGS. 43–44. These are not exclusive as there are many other types of connectors 309 known in the art for connecting two parts or sections together.

It should be appreciated that the multi-part handle 302 allows a user to form a variety of different handle configurations. Depending upon the particular implement selected and the job to be accomplished, different parts or sections may be selected to assemble the multi-part handle 302 in a specific configuration based on the particular use and user to reduce the stress and fatigue resulting from use of conventional handles. Further, the multi-part handle 302 eliminates the necessity for several different handles when using various implements. This is truly a one-size fits all handle.

Figures 37A, 38A, 38B:
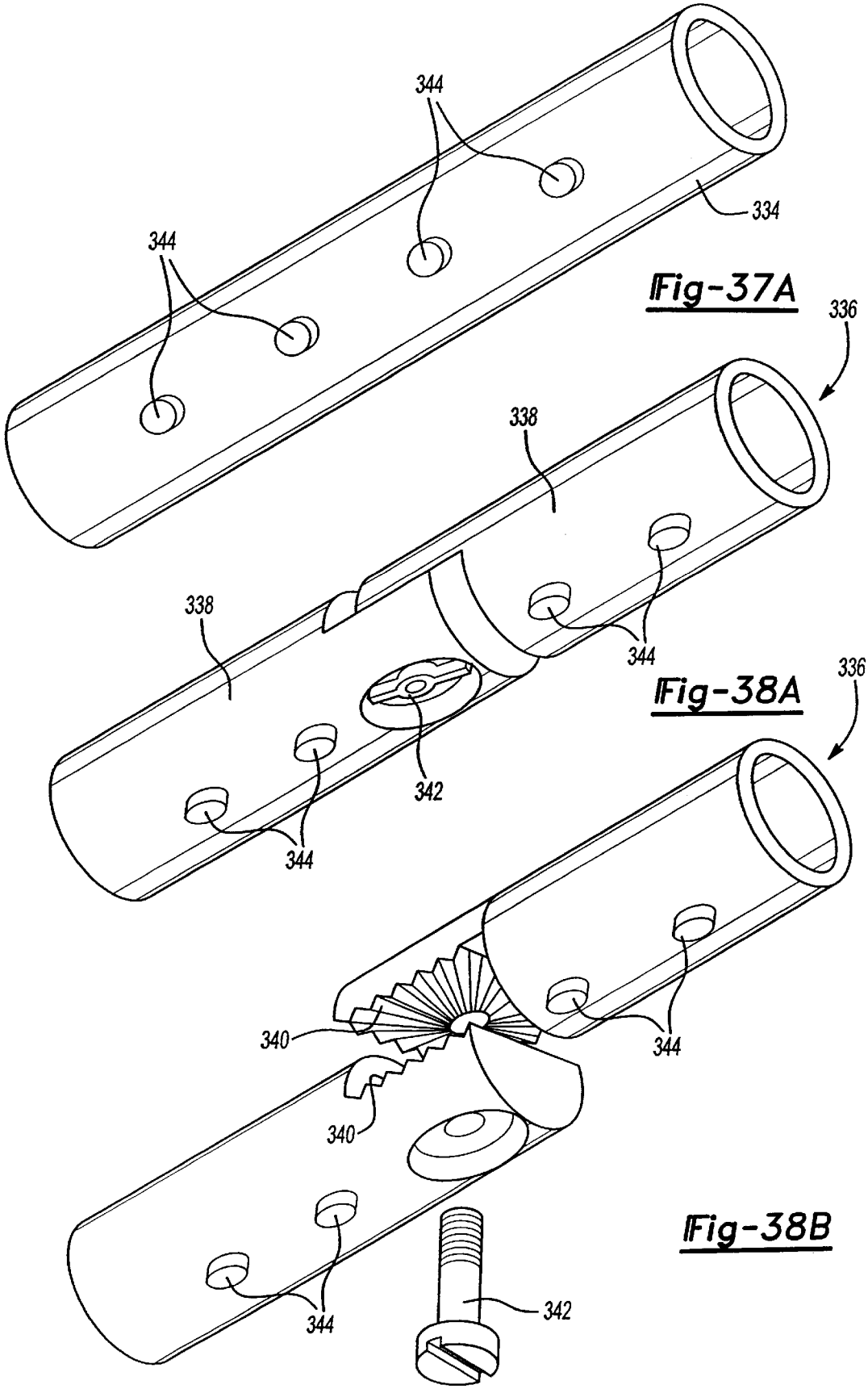

Returning to the specifics, the shaft section 306 may be formed of several different styles of shaft portions including a shaft 314 being bent or having two offset axes at both ends 320, 322 (see FIG. 28). FIG. 29 shows a straight shaft 316 with a single longitudinal axis having opposite ends 324, 326 adapted to receive a connector 309 therein. FIG. 30 discloses a straight shaft 318 having a single longitudinal axis, formed with a means for adjustment thereon such that the shaft 318 may telescope or extend to increase or decrease the distance between the respective ends 328, 330. A similar arrangement is shown in FIG. 11. Other types or designs of shaft sections 306 may be used depending upon the particular use or configuration desired by the user. The means for connecting the center section 308, the shaft section 308 and the upper section 310 includes a variety of connectors 309, examples of which are disclosed in FIGS. 37–41 and FIGS. 43–44. The connectors 309 are various types of connecting links that are either fixed or removable which allow any two parts or sections to be connected to one another in an incremental fashion either axially, radially, rotationally, and in some cases, longitudinally. For instance, the fixed link 334 shown in FIGS. 37–37*a* is a stationary link that simply joins the parts or sections together. The link 336 shown in FIGS. 38, 38*a* and 38*b* includes a pivot 337 enabling the sections to adjust both axially and rotationally. As shown, opposing sections 338 of the connecting link 336 contain a plurality of opposite serrated surfaces 340 which mate together and are held in position by a fastener 342 such as a screw or wing nut. Such an adjustable connector is also shown in FIGS. 7*a*–7*c*. The connecting link 336 also uses a plurality of spring loaded pins 344 which are inserted and received in apertures in the respective sections for rotational adjustment (see FIG. 8).

Figure 39A:
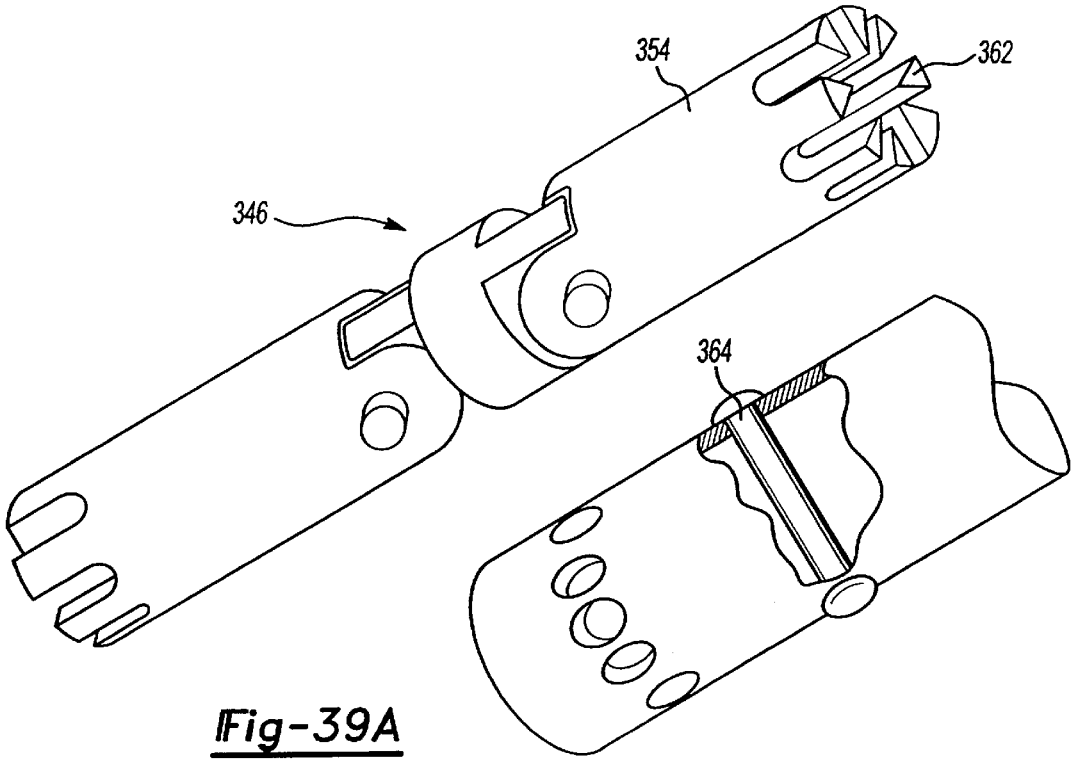
Figure 39B:
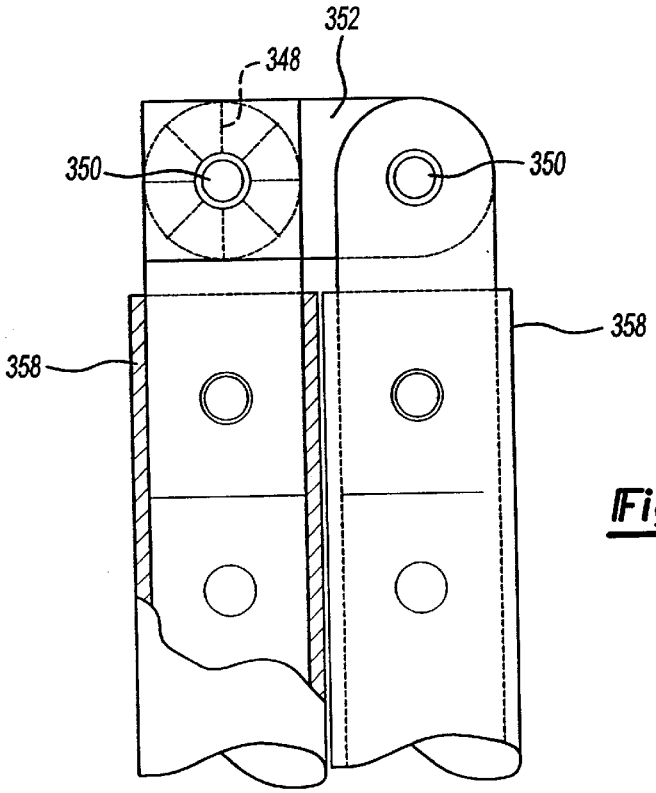
Figure 39C:
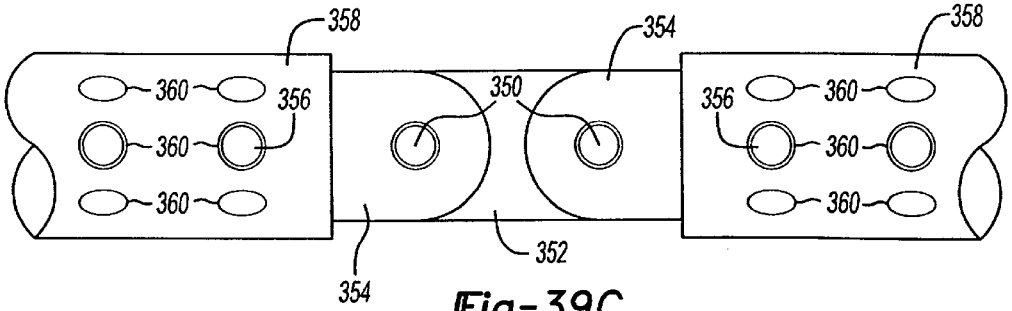
Figure 39D:
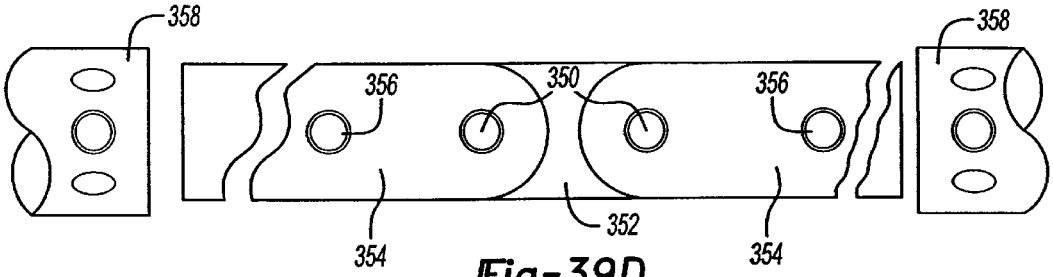
Figure 39E:
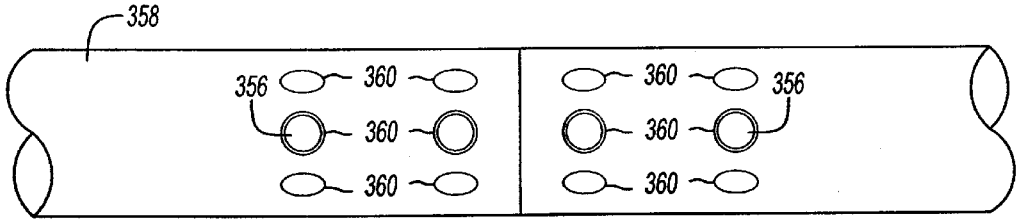
Figure 40A:
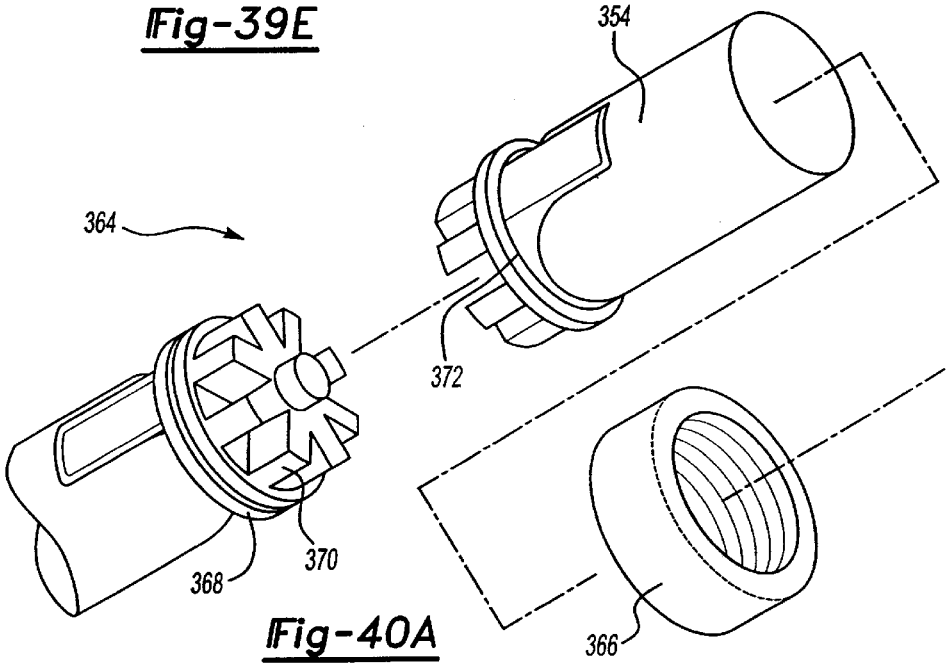

FIGS. 39*a*–39*e* disclose a double pivoting link 346 also having axial and rotational adjustability. The link 346 is similar to that shown in FIGS. 9*a*–9*b*. The link 346 provides a two fold function. First, it allows the component parts or sections to be connected, and folded into a compact storage position. Second, it allows the sections to be adjusted relative to one another. Similar to the pivotal link shown in FIG. 38, the link 346 uses opposing complementary mating surfaces 348 held together by fasteners 350. As shown, an intermediate portion 352 is positioned between end portions 354 of the link 346. As discussed above, the intermediate portion 352 and end portions 354 are pivotally connected through complementary surfaces 348. The end portions 354 also include detent pins 356 that cooperate with apertures 360 on the ends 358 of the sections. The number of apertures 360 depends on the versatility desired. For instance, the more apertures 360, the more the handle may be adjusted by rotating the respective sections relative to one another. FIG. 39*a* shows a variation of link 346 that provides both the ability to fold adjacent parts or sections against each other and the ability to rotate the sections with respect to one another. An end portion 354 has a plurality of slots 362 cut therein. When the end portion 354 is slid inside the part or section, the slots 362 engage a pin 364 fixed on the section. As shown in FIG. 39*a*, the end portion 354 can be rotated to a number of discreet positions to allow adjustability between adjacent sections. Again, detent pins 356 engage apertures 360 to hold the section on the link 346.

Turning now to FIG. 40, a pivoting link 364 is shown. The link 364 includes a pin and slot connection similar to that disclosed above that allows rotatability of adjacent sections. A threaded collar 366 slides over the end portion 354 and engages threads 368 to keep the pin 370 and slots 372 in a mated relationship and prevent rotational movement between the respective sections.

FIGS. 41 and 41*a* show a connector 374 which may be used to connect a section to a wood shaft 190. An annular member 376 having a plurality of inwardly deflectable fingers 378 each having an inwardly extending end projection 380 thereon is slid over the wood handle. A collar 382 slides over the top of the annular member 376. As the collar 382 slides axially along the annular members 376, it engages and drives the inwardly deflectable fingers 378 such that the end projections 380 engage and fasten the annular member 376 to the wood handle 190. A detent pin 384, which can be spring operated, extends through an aperture 386 and fixes the collar 382 on the annular member 376. This link 374 may also include the pin 362 and slot 364 adjustment feature of FIG. 39*a*.

Figure 43:
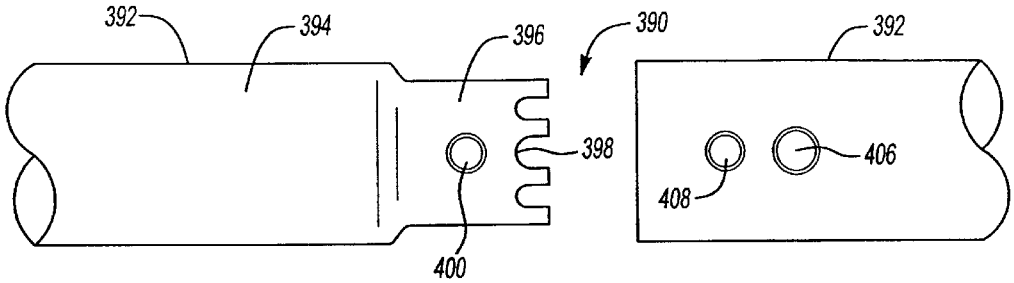
Figure 43A:
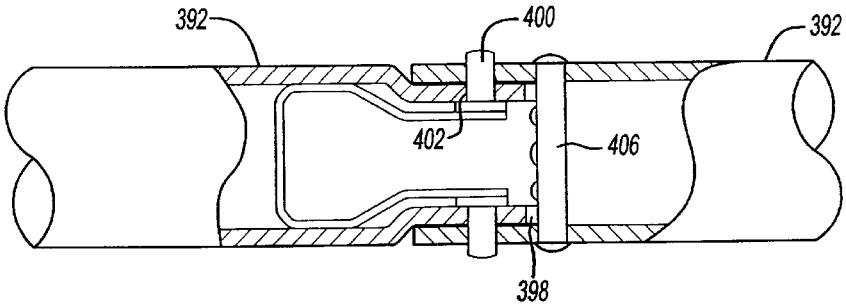

FIGS. 43 and 43*a* show a connector 390 which may be formed on the ends 392 of a particular section for joining adjacent sections. For instance, one section will have a male end 394 comprising a reduced neck section 396 having a plurality of slots 398 cut therein. A spring loaded detent pin 400 extends outwardly through an aperture 402 on the reduced neck section 396. The reduced neck section 396 is received in a socket 404 on the adjacent section. The socket 404 has a fixed pin 406 extending therethrough which mates with the slots 398 on the reduced neck section 396. The receiving end has a plurality of apertures 408 to receive the detent pin 400 depending upon the angular orientation or rotation between the two sections.

Figure 44:
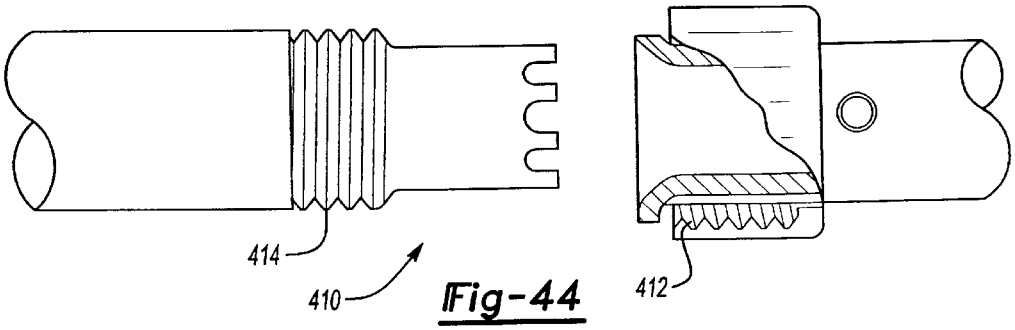

FIG. 44 shown a similar connection 410 using a threaded collar 412 and threaded member 414 to hold the two sections together. Thus, it should be appreciated that the various sections 306, 308, 310 may be held together by the connectors 309 shown herein. The connectors 309 typically are used to connect the shaft section 306 with the center section 308 and the center section 308 with the upper section 310, but may also be used to connect the implement 304 to the shaft section 306 or, for that matter, any other section.

Figure 42C:
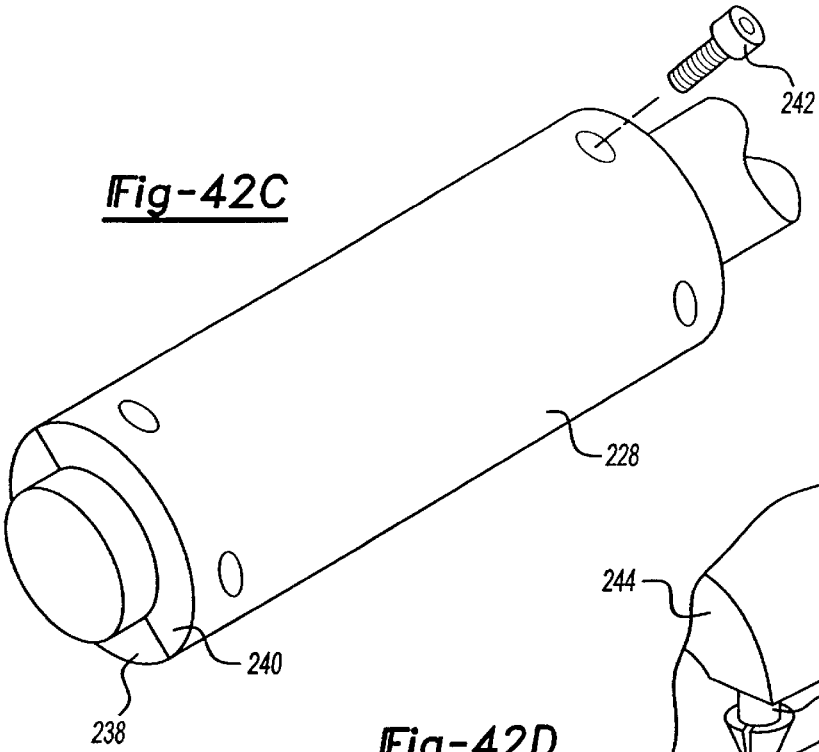
FIG. 42*a*–42*d* shows several embodiments of a detachable hand grip for use with the present invention.
Figure 42D:
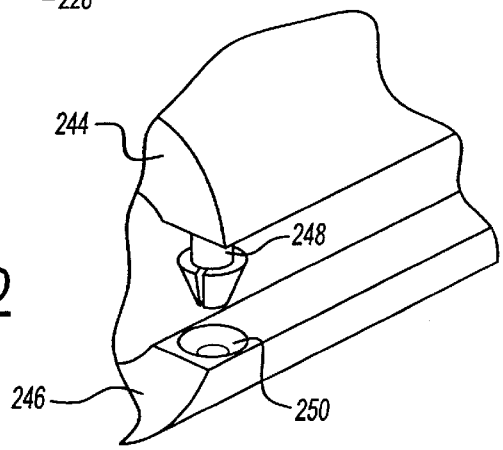
Figure 42E:
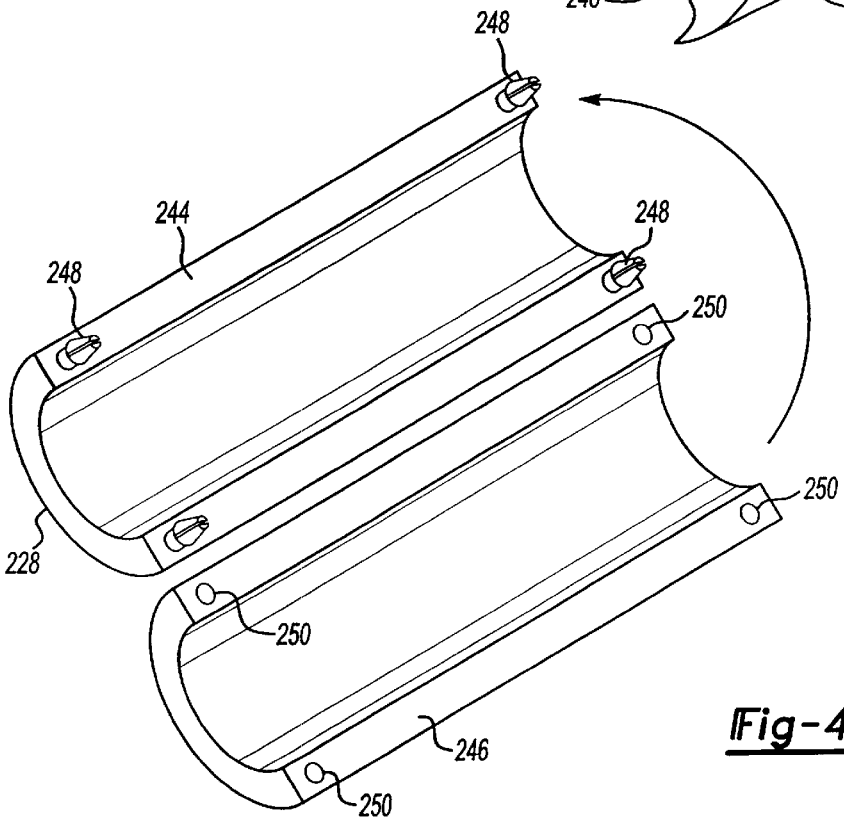

Turning to FIGS. 42*a*–42*d*, detachable hand grips 228 for use with the handle are shown. The hand grip 228 is releasably attached to the various sections at different positions depending upon the operator's proposed use. FIG. 42*a* shows a detachable hand grip 228 using a hook 230 and loop 232 fastener to attach the grip to the handle; FIG. 42*b* discloses a ratchet 234 and pawl 236 fastener assembly; FIG. 42*c* shows a hand grip 228 split into halves 238, 240 held together by threaded fasteners 242; and FIG. 42*d* shows a hand grip 228 split into two halves 244, 246, one section having deflectable fingers 248 that extend through an aperture 250 on a mating half 246 to hold the two halves together.

As discussed previously, the center section 308 may be formed as the center sections identified in FIGS. 16–17. FIG. 32 discloses a center portion 200 having a single longitudinal axis 201 with the ends set up to receive the connectors 309. As shown, the upper sections 310 including the handles shown in FIGS. 34–36, specifically, an offset l-shaped handle 420, a t-shaped handle 422 and a straight handle 424, are connected via the connectors 309 to the center section 308. As shown, the upper sections 310 include a rear grip portion and a configuration similar to that shown on the shaft section 306 and the center section 308 that allows it to be adjusted relative to the center section 308 or shaft section 306.

Figure 45A:
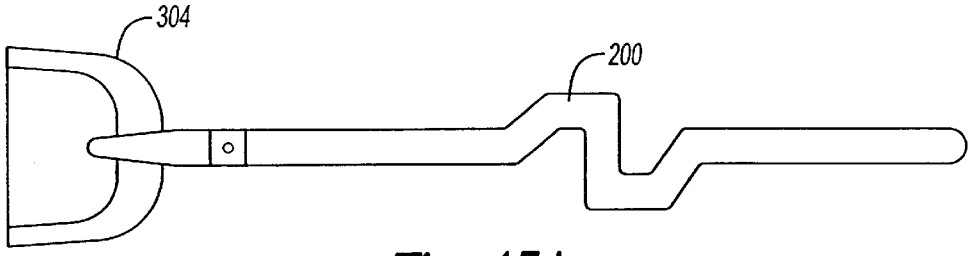
FIGS. 45*a*–45*d* discloses several embodiments of a handle according to the present invention.
Figure 45B:
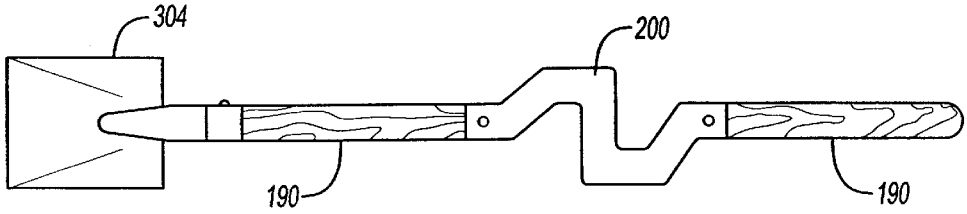
Figure 45C:
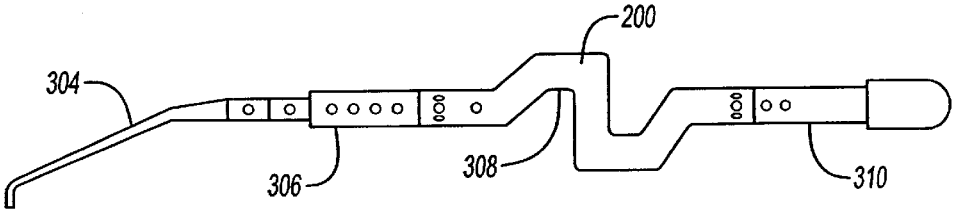
Figure 45D:
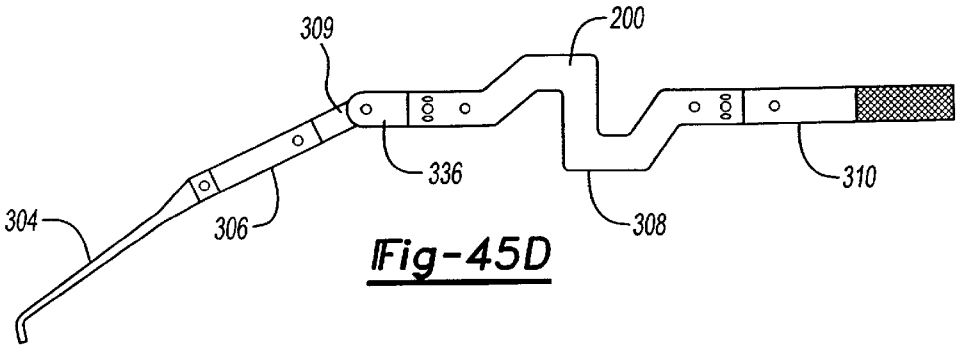

FIGS. 45*a*–45*d* show the various uses of the present invention when embodied in a handle. Specifically, FIG. 45*a* shows a continuous shaft handle having the shape or configuration like that of the center section 200. FIG. 45*b* shows an add-on center section 200 disposed between two wooden sections 190 of a straight handle shaft. FIG. 45*c* shows a multi-part handle having the shaft 306, center 308 and upper section 310 interconnected by connectors 309. FIG. 45*d* shows a multi-part handle with a pivotal link 336 allowing the shaft section 306 to be positioned in an angular relationship with respect to the center section 308 and upper section 310 of the multi-part handle.

It should be appreciated that the disclosed component style handle provides an apparatus in which the center portion can be used as an add-on to conventional type straight handles, the handle may be separated into numerous sections for storage, the sections can be connected by various fasteners allowing the respective adjacent sections to be repositioned with respect to one another. This provides a handle wherein the user can custom fit or modify the handle to provide a handle which evenly distributes the forces to reduce the stress on the user.

The invention has been described in an illustrative manner. It is to be understood that the terminology which has been used is intended to be in the nature of words of description rather than of limitation.

Many modifications and variations of the invention are possible in light of the above teachings. Therefore, within the scope of the appended claims, the invention may be practiced other than as specifically described.

I claim:

1. A handle for attachment to an implement comprising:

a shaft section having one end thereof configured such that an implement may be attached thereto;

a center section;

a first connector connecting said shaft section to said center section; an upper section;

a second connector connecting said center section to said upper section; and said center section includes a first skewed section, a transverse section and a second skewed section, said transverse section positioned between said first and second skewed sections.

2. A handle as set forth in claim 1 wherein said upper section includes a grip portion.

3. A handle for attachment to an existing implement handle comprising a first skewed section, a transverse section and a second skewed section interconnected such that said transverse section is positioned between said first and said second skewed sections; said implement handle including a first longitudinal section positioned adjacent and connected to said first skewed section, said first longitudinal section having one end thereof configured such that the existing implement handle may be attached thereto and a second longitudinal section positioned adjacent and connected to said second skewed section.

4. A handle for attachment to an implement comprising:

a shaft section having one end thereof configured such that the implement may be attached thereto;

a center section including at least one skewed section and a transverse section and an upper section;

a first connector disposed between and releasably securing said center section to said shaft section; and a second connector disposed between and releasably securing said upper section to said center section.

5. A handle as set forth in claim 4 wherein said first connector includes a link having opposite ends, and a detent pin on each end thereof.

6. A handle as set forth in claim 4 wherein said second connector includes a link having opposite ends, and a detent pin on each end thereof.

7. A handle as set forth in claim 5 wherein said link includes a pivot, said pivot including a pair of complementary surfaces formed on said link.

8. A handle as set forth in claim 6 wherein said link includes a pivot, said pivot including a pair of complementary surfaces formed on said link.

* * * * *